United States Patent [19]

Brunnel et al.

[11] Patent Number: 4,971,012

[45] Date of Patent: Nov. 20, 1990

[54] DISTRIBUTOR FUEL INJECTION RADIAL PISTON PUMP

[75] Inventors: André Brunnel, St. Genis; Jean P. Morel-Fourrier, Valencin; Jean Leblanc, Lyon, all of France

[73] Assignee: Robert Bosch GmbH, Stuttgart, Fed. Rep. of Germany

[21] Appl. No.: 314,581

[22] PCT Filed: May 28, 1988

[86] PCT No.: PCT/DE88/00311

§ 371 Date: Jan. 25, 1989

§ 102(e) Date: Jan. 25, 1989

[87] PCT Pub. No.: WO88/09870

PCT Pub. Date: Dec. 15, 1988

[30] Foreign Application Priority Data

Jun. 13, 1987 [DE] Fed. Rep. of Germany ..... 3719807

[51] Int. Cl.[5] ..... F02M 63/02

[52] U.S. Cl. ..... 123/450; 123/198 D; 123/387; 123/506

[58] Field of Search ..... 123/198 D, 387, 450, 123/506

[56] References Cited

U.S. PATENT DOCUMENTS 3,485,225 12/1969 Bailey et al. ..... 123/450
4,538,580 9/1985 Straubel et al. ..... 123/450 X
4,840,162 6/1989 Brunel ..... 123/450 X

FOREIGN PATENT DOCUMENTS 3612942 10/1987 Fed. Rep. of Germany .

*Primary Examiner*—Gerald A. Michalsky
*Attorney, Agent, or Firm*—Michael J. Striker

[57] ABSTRACT

A distributor fuel injection radial piston pump comprising a distributor piston movable between first and second axial positions to communicate a pump working space with an injection nozzle and to prevent communication between the pump working space with the injection nozzle, a control valve for controlling a quantity of fuel fed to the injection nozzle and movable between open and closed position to communicate the pump working space with the pump interior therethrough in the open position thereof to prevent feeding of fuel to the injection nozzle and blocking communication between the pump working space and the pump interior therethrough in the closing position thereof to provide for feeding fuel to the injection nozzle, and means for preventing excessive feeding of fuel to the nozzle in case of failure of the first control valve to move from the closing position thereof to the open position thereof in response to a predetermined control signal, the preventing means including a control space defined at least partially by the end face of the distributor piston and a second control valve for changing pressure in the control space to move said distributor piston to the second axial position thereof in which feeding of fuel to the injection nozzle is prevented.

17 Claims, 6 Drawing Sheets

DISTRIBUTOR FUEL INJECTION RADIAL PISTON PUMP

BACKGROUND OF THE INVENTION

The invention relates a distributor fuel injection radial piston pump for internal combustion engine.

In such distributor fuel injection pumps, such as are described, for example, in the German Patent Application No. P 36 12 942.9, the pump work space is always completely filled with fuel during the suction stroke of the pump piston. The quantity of the injected fuel volume is determined as a function of parameters of the internal combustion engine, such as load and speed, by a point of time at which the electric control valve is closed and opened. When the control valve closes, the fuel is injected into the respective cylinder of the internal combustion engine, whereas the pump work space communicates with the relief space when the control valve opens and the fuel injection is accordingly corruptly terminated. When there is a defect in the control valve such that it remains stuck in its closing position and no longer opens, the internal combustion engine is always supplied with a maximum fuel injection quantity regardless of load, and the speed of the internal combustion engine accumulates in such a way that it cannot be influenced and the internal combustion engine "races".

SUMMARY OF THE INVENTION

The object of the invention is a distributor fuel injection pump, in which delivery of fuel from the pump work space to an injection nozzle is interrupted in the event the control valve becomes stuck in its closing position. The internal combustion engine accordingly stops due to the absence of an ignition mixture. The defect in the control valve is detected by a monitoring device which then transmits a closing command to the second control valve. The increase in speed of the internal combustion engine over a maximum speed, for example, can be a criterion for the defect in the first control valve. The second control valve is preferably constructed in such a way that it is normally closed and opens when controlled. The second control valve closes when the control stops. The closing command consists in an interruption of the exciting current for the electromagnet of the second control valve. In this way, the fuel delivery is also interrupted when the control line of the second control valve experiences disturbance. The second control valve can be much simpler and accordingly cheaper than the first control valve.

DRAWING

The invention as to its construction so as to its method of operation, together with additional objects and advantages thereof, will be best understood from the following description with reference to the accompanying drawing, wherein FIG. 1*a* shows a longitudinal cross-sectional view of a first embodiment of a distributor fuel injection radial piston pump according to the present invention in a normal operating position thereof;

FIG. 1*b* shows a longitudinal cross-sectional view of the pump shown in FIG. 1*a* but in a position when its normal operation is interfered with;

FIG. 2*a* shows a longitudinal cross-sectional view of a second embodiment of a distributor fuel injection radial piston pump according to the present invention in a normal operating position thereof;

FIG. 2*b* shows a longitudinal cross-sectional view of the pump shown in FIG. 2*a* but in a position when its normal operation is interfered with;

FIG. 3*a* shows a longitudinal cross-sectional view of a third embodiment of a distributor fuel injection radial piston pump according to the present invention in a normal operating position thereof;

FIG. 3*b* shows a longitudinal cross-sectional view of the pump shown in the FIG. 3*a* but in a position when its normal operation is interfered with;

FIG. 4*a* shows a longitudinal cross-sectional view of a fourth embodiment of a distributor fuel injection radial piston pump according to the present invention in a normal operating position thereof;

FIG. 4*b* shows a longitudinal cross-sectional view of the pump shown in FIG. 4*a* but in a position when its normal operation is interfered with.

DESCRIPTION OF THE PREFERRED EMBODIMENTS

Figure 1A:
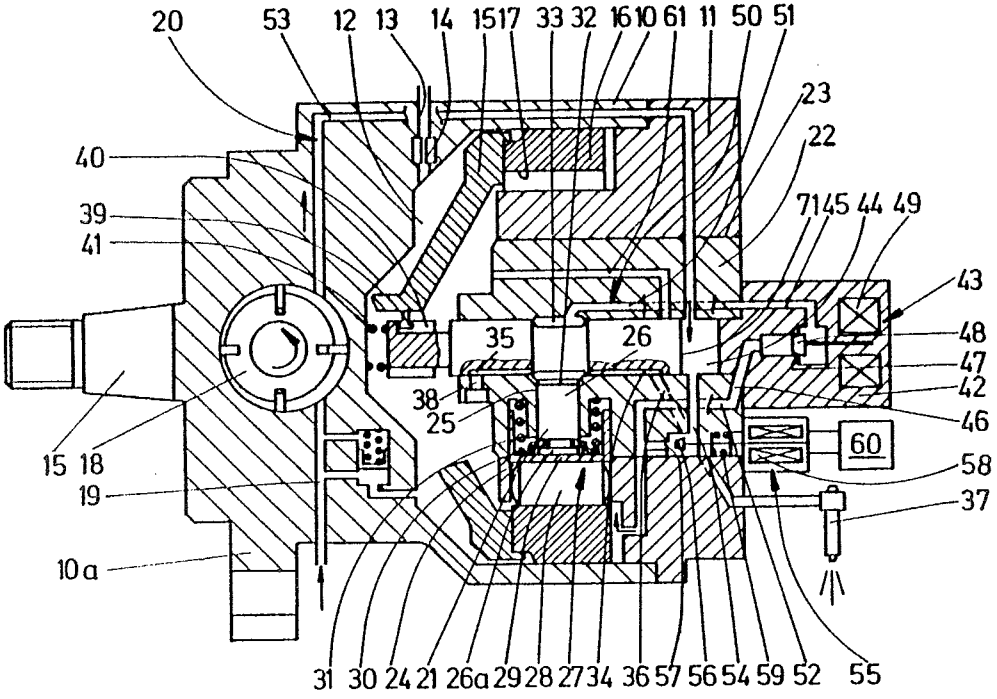

A distributor fuel injection radial piston pump shown in FIG. 1 comprises a cup-shaped housing 10 and a cover 11 closing the latter, which cover 11 is slid in from the open end of the housing 10 and defines a pump interior 12 with a base 10*a* which forms one piece with the housing 10. The pump interior 12 is filled with fuel under low pressure and is connected with a fuel return line leading to a fuel tank (neither one is shown) via an outlet opening 13 with a throttle 14 located upstream thereof. A drive shaft 15 extends through the base 10*a* housing 10 and is to sealed against fluid leakage. The shaft 15 widens in a cup-shaped manner in the pump interior 12 and carries a cam ring 16 along its edge, which cam ring 16 is connected thereto for joint rotation therewith fixed. On its inside, the cam ring 16 has a cam face 17 with radially inwardly directed cams which correspond in number and sequence to the number and sequence of radial pump pistons of the fuel injection pump, and to the number of piston strokes of these pump pistons per a revolution of the drive shaft 15. A feeding pump 18 is supported on the drive shaft 15 and is connected with the fuel tank via an inlet line 19 and with the pump interior 12 via a pressure line 20 and accordingly ensures the filling of the pump interior 12 with fuel.

In addition, a distributor piston 21 is connected to the drive shaft 15 for joint rotation therewith but for axial displacement relative thereto. The axis of the distributor piston is aligned with the axis of the drive shaft 15. The distributor piston 21 is guided in a distributor cylinder 22 until the end which is connected with the drive shaft 15 in the pump interior 12. The distributor cylinder is held in a bore 23 of the cover 11, which bore 23 is coaxial with the axis of the drive shaft 15. Guides 24, which are uniformly distributed along the circumference of the distributor cylinder 22 and extend until the vicinity of the distributor piston 21, are provided in the cover 11 and in the distributor cylinder 22 adjacent to the cam face 17 so as to be connected in a radially inward direction. For a distributor injection pump shown in FIG. 1 for supplying a total of three injection nozzles of an internal combustion engine, particularly a diesel engine, there is a total of three guides 24, only one of which can be seen in FIG. 1. Radial through holes 25 are provided in the distributor cylinder 22 coaxially relative to the guides 24. A pump piston 26 is guided into the radial through holes 25 in each instance so as to be longitudinally displaceable. A so-called roller tapper 27, which comprises a roll or roller 28 and a tappet cup 29, is guided into the guides 24 in each instance so as to be longitudinally displaceable. A tappet spring 31, which is supported on the base of the guide 24, on one side, and at a spring disk 30 contacting the base of the tappet cup 29 on the other side, presses the tappet cup 29 against the roller 28 and the latter against the guide face 17. The spring disk 30 engages behind a collar **26*a* of the pump piston 26, which collar 26*a* projects out of the radial through bore-hole 25, and accordingly fastens the collar 26*a* at the tappet cup 29**.

Every pump piston 26 defines a pump work space 32 in the radial through hole 25, the pump work space 32 being defined, on the other hand by an annular groove 33 on the distributor piston 21. A distributor groove 34 and a filling groove 35 open into the annular groove 33 and extend away from the annular groove 33 axially in opposite directions on the distributor piston 21. Three injection bores 36, which are uniformly distributed along the circumference of the distributor cylinder 22 and lead through the distributor cylinder 22 and the cover 11 until an injection nozzle 37, open into the interior of the distributor cylinder 22 in a cross-sectional plane. One of the three injection nozzles 37 is shown schematically in FIG. 1. The axial length of the distributor groove 34 is dimensioned in such a way that it projects until the cross-sectional plane of the openings of the injection bores 36 and accordingly connects one of the three injection bores 36 with the annular groove 33 according to the rotational position of the distributor piston 21. In another cross-sectional plane in the vicinity of the end of the distributor cylinder 22 facing the pump interior 12, three filling bores 38 open into the interior of the distributor cylinder 22 and are arranged so as to be uniformly distributed at the circumference of the distributor cylinder 22. The axial length of the filling groove 35 is dimensioned in such a way that it projects until these cross-sectional planes of the openings of the filling bores 38 and accordingly, connect one of the three filling bores 38 with the annular groove 33 according to a rotational position of the distributor piston 21. The coupling of the distributor piston 21 to the drive shaft 15 is effected via a pin-in-slot connection in which a driving pin 39 engages at the drive shaft 15 in a form-locking manner in a longitudinal groove 40 in the distributor piston 21. The basic position of the distributor piston 21 shown in FIG. 1 is fixed by a helical pressure spring 41 which biases the end of the longitudinal groove 40 against the driving pin 39 which, accordingly, forms a limiting stop for the axial displacing movement of the distributor piston 21.

The valve housing 42 of an electric control valve 43 is placed on the outwardly facing front side of the cover 11 and is fastened there in a corresponding manner. The valve housing 42 engages with a centering pin in the inner hollow space of the distributor cylinder 22 and defines a control space 44 together with an end face 71 of the distributor piston 21 opposite it. The construction of the control valve is known and is described, e.g. in the DE-OS No. 35 23 536. Briefly stated, the two valve connections 45, 46 of the control valve 43 are connected with one another via a valve opening 47 which is controlled by an electromagnet. A valve member 48 is actuated by an electromagnet 49, wherein the valve member 48 releases the valve opening 47 in the unexcited state of the electromagnet 49 by the action of a return spring, not shown, and closes it in the excited state of the electromagnet 49. The valve connection 45 overlaps a first bore portion 51 of a relief line 50 opening into the front side of the cover, whereas the second valve connection 46 overlaps with an opening of a second bore portion 52 of the relief line 50, which opening is located in the front side of the cover 11. The pump work space 32 communicates with the pump interior 12 via the relief line 50.

The pressure line 20 between the feeding pump 18 and the pump interior 12 extends in the distributor cylinder 22 via the control space 44, the pressure line 20 being divided into first and second line portions 53, 54 by the distributor cylinder 22. A second electric control valve 55, controls a valve opening 57 in the second line portion 54 with a valve member 56 arranged in the second line portion 54 which connects the control space 44 with the pump interior 12. The valve member 56 is actuated by an electromagnet 58. The valve member 56 closes the valve opening 57 in the unexcited state of the electromagnet 58 due to the action of a valve closing spring 59 and opens it in the excited state of the electromagnet 58. The second control valve 55 is controlled by a monitoring device 60 which continuously monitors the unobjectionable functioning of the first control valve 43 and transmits a closing command to the second control valve 55 by turning off the exciting current for the electromagnet 58 as soon as the valve member 48 of the first control valve 43 does not open in spite of the absence of the excitation of the electromagnet 49. Such a monitoring device 60 can be formed, e.g., as a speed detector which transmits the closing command to the second control valve 55 when the speed of the internal combustion engine exceeds a predetermined maximum speed, which is an indication that the first control valve 43 no longer opens. When the second control valve 55 closes, the connection of the control space 44 to the pump interior 12 is blocked and a pressure is built up in the control space 44 by the feeding pump 18, which pressure moves the distributor piston 21 to an axial displacing position shown in FIG. **1*b*. In this axial displacing position, an opening of a hole 61 which is otherwise closed, is opened by the distributor piston 21, and it now connects the control space 44 with the pump interior 12. In addition, as shown in FIG. 1*b*, the end of the distributor piston 21 facing the pump interior 12 is pushed out of the distributor cylinder 22 far enough so that the filling groove 35 is open toward the pump interior 12 and forms a continuous connection between the pump work space 32 and the pump interior 12**.

The manner of operation of the fuel injection pump described above is as follows:

During a suction stroke of the pump piston 26, the latter moves radially outward as a result of the sliding of the roller tappet 27 on a descending flank of the cam face 17. The rotational position of the distributor piston 21 is such that the filling groove 35 overlaps the filling bore 38. The first control valve 43 is open in an absence of current and the second control valve 55 is likewise opened by applied current. Fuel now flows into the pump work space 32 via the filling bore 38, the filling groove 35 and the annular groove 33. After the pump piston 26 passes through the bottom dead center position, the discharge stroke of the pump piston 26 begins, wherein the pump piston 26 moves radially inward as a result of the sliding of the roller tappet 27 on an ascending flank of the cam face 17. In so doing, fuel is guided back into the pump interior 12 from the pump work space 32 via the relief line 50 and the first control valve 43 which is still open. At a predetermined point of time during the discharge stroke, the first control valve 43 is closed during the delivery stroke. The distributor piston 21 has then, at the latest, reached a rotational position in which the distributor groove 34 overlaps the injection bore 36 and, accordingly, connects the pump work space 32 with the assigned injection nozzle 37 via the injection bore 36. Fuel is now fed to the injection nozzle 37 from the pump work space 32 and is injected into the cylinder of the internal combustion engine. In order to terminate the fuel injection, the first control valve 43 is switched to the currentless state so that, upon opening control valve 43 connects the pump work space 32 to the pump interior 12 via the annular groove 33 and the relief line 50. The pressure in the pump work space 32 suddenly drops below the opening pressure of the injection nozzle 37 and closes it. The fuel quantity which is delivered to the injection nozzle 37 and injected therefrom is metered in accordance with the time of closing and/or opening of the first control valve 43.

Figure 1B:
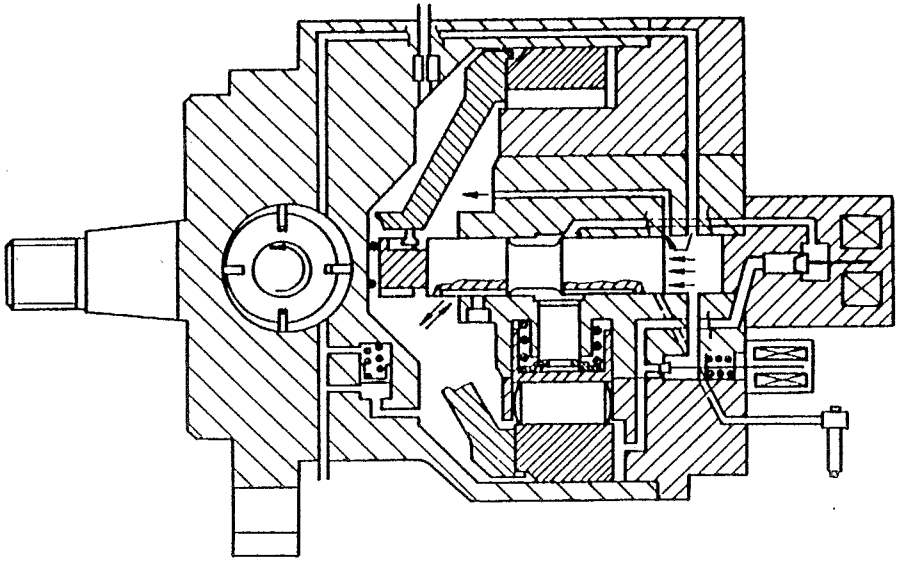

FIG. 1*b* shows the fuel injection pump in the event when the first control valve 43 is defective, and its valve member 48 does not open the valve opening 47 in spite of the absence of the exciting current for the electromagnet 49. This is a case of the first control valve 43 sticking in the closing state. Because of this defect, the entire quantity of fuel contained in the pump work space 32 is injected via the injection nozzle 37 during every discharge stroke of the pump piston 26. The speed of the internal combustion engine accordingly constantly increases. This excessive speed of the internal combustion engine is detected by the monitoring device 60 and the latter transmits a closing command to the second control valve 55. This closing command turns off the exciting current for the electromagnet 58 of the second control valve 55. The second control valve 55 closes due to the action of the valve closing spring 59. Accordingly, the control space 44 in the distributor cylinder 22 is separated from the pump interior 12. As a result of fuel supply by the feeding pump 18, the pressure in the control space 44 increases and displaces the distributor piston 21 into the axial displacement position shown in FIG. 1*b*. In this displacement position, the filling groove 35, which opens into the pump work space 32, extends into the pump work space 12 so that the pump work space 22 is connected with the pump interior 12. During the discharge stroke of the stroke of the pump piston 26, the fuel now flows out of the pump work space 32 via the filling groove 35 into the pump interior 12, so that no pressure exceeding the opening pressure of the injection nozzle 37 can be built up in the pump work space 32. Accordingly, no fuel is fed to the injection nozzle 37, and the internal combustion engine stops because of the lack of fuel. In the axial displacement position of the pump piston 21, the bore 61 is open in the direction of the control space 44, so that the fuel still being fed by the feeding pump 18, can flow into the pump interior 12 via the bore 61 when the second control valve 55 is closed.

Figure 2A:
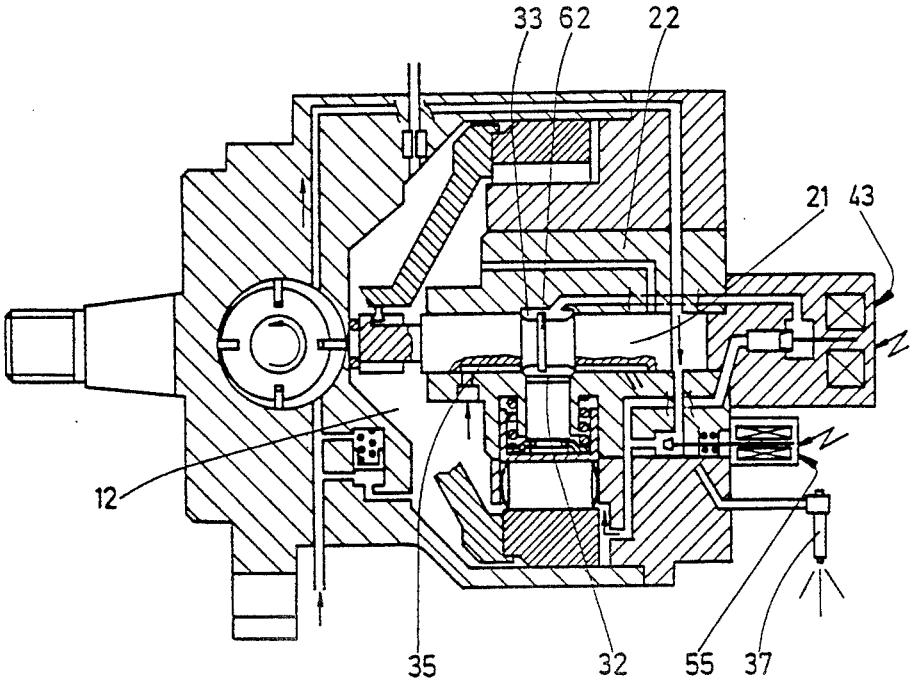
Figure 2B:
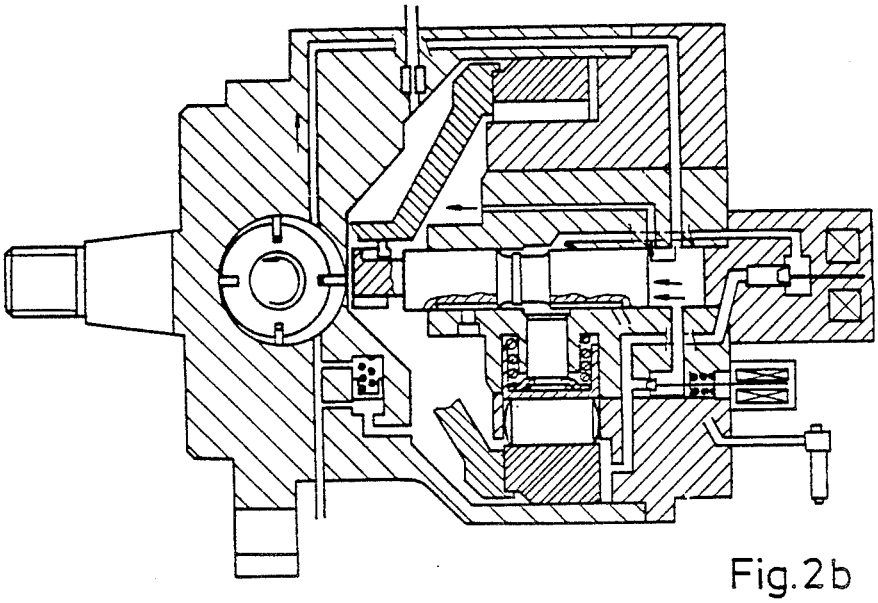

The second embodiment of a distributor fuel injection radial piston pump, which is shown in FIG. 2, differs from the fuel injection pump in FIG. 1 only in that the annular groove 33 on the distributor piston 21, which annular groove 33 defines the pump work space 32, is divided by a ring land 62 having an external diameter corresponding to the external diameter of the distributor piston 21. The ring land 62 is located within the annular groove 33 in such a way that the ring land 62, together with the inner wall of the distributor cylinder 22, separates the left-hand portion of the annular groove 33 in FIG. 2 from the right-hand portion of the annular groove 33 and, accordingly, from the pump work space 32, in the axial displacement position, shown in FIG. 2*b*, occupied by the distributor piston 21 during a defect in the first control valve 43. Since the filling groove 35 opens into this portion of the annular groove 33 which is now sealed off, the filling groove 35 is separated from the pump work space 32 in the axial displacement position of the distributor piston 21 in each of its rotational positions and, accordingly, blocks the pump work space 32 relative to the pump interior 12 which is filled with fuel. Accordingly, during the suction stroke of the pump piston 26 no fuel can reach the pump work space 32, and the delivery of fuel from the pump work space 32 to the injection nozzle 37 is prevented. In contrast to the fuel injection pump in FIG. 1, the axial length of the filling groove 35 in this instance is dimensioned so as to be shorter, and the filling bore 38 is located at a greater distance from the end of the distributor cylinder 22 on the pump interior side, so that the filling groove 35 is not opened to the pump interior 12 by the distributor cylinder 22 in the axial displacement position of the distributor piston (FIG. 2*b*).

Instead of providing a ring land 62, the annular groove 33 itself can be formed so as to be narrow enough that it is overlapped by the through holes 25 in the distributor cylinder 22 in the normal operating position of the distributor piston 21 (FIG. 2*a*), and is covered by the inner wall of the distributor cylinder 22 in the axial displacement position of the distributor piston 21 (FIG. 2*b*) in its full length.

Figure 3A:
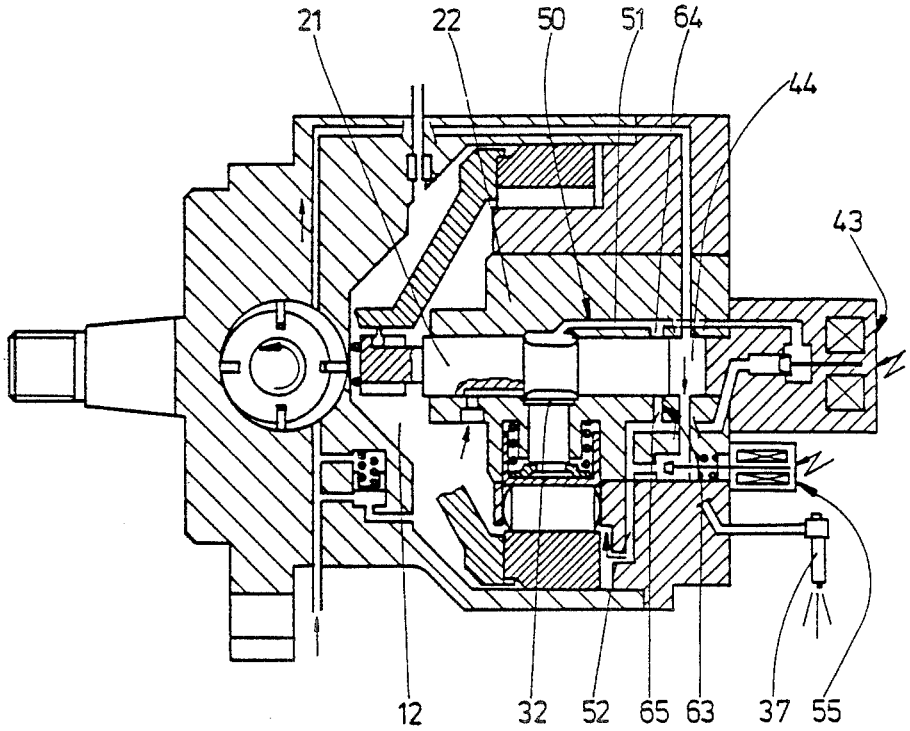
Figure 3B:
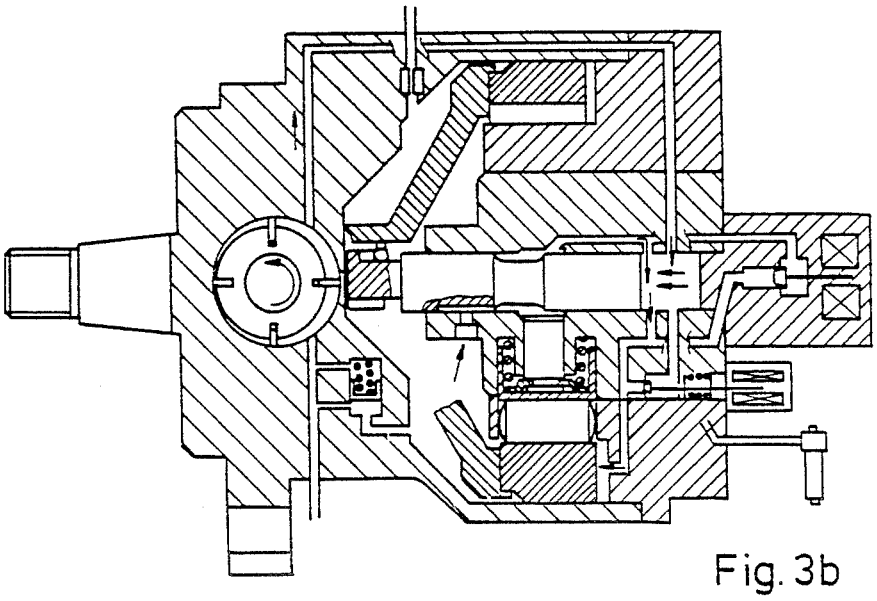

Another embodiment of a distributor fuel injection radial piston pump type shown in FIG. 3 differs from the fuel injection pump in FIG. 1 in that a by-pass 63 is provided in the relief line 50, which by-pass 63 bridges the first control valve and is opened or closed by the distributor piston 21. For this purpose, a first by-pass portion 64 is connected with the first bore portion 51 of the relief line 50 and a second by-pass portion 65 is connected with the second bore portion 52 of the relief line 50. Every by-pass portion 64, 65 opens into the interior of the distributor cylinder 22. The openings are arranged in such a way that they are sealed off by the distributor piston 21 in the normal operating position of the distributor piston 21 (FIG. 3*a*) and open into the control space 44 in the axial displacement position (FIG. 3*b*) occupied by the distributor piston 21 during a defect in the first control valve 43. The pump work space 32 is accordingly connected with the pump interior 32 in the axial displacement position of the distributor piston 21 in all of its rotational positions via the control space 44, which closes the by-pass 63, and the relief line 50 so that the fuel which is located in the pump work space 32 is supplied to the pump interior 12 during the discharge stroke of the pump piston 26 via the relief line 50. Also, in this instance, fuel feeding to the injection nozzle 37 is prevented in the axial displacement position of the distributor piston 21 which resulted from the closing of the second control valve 55.

Figure 4A:
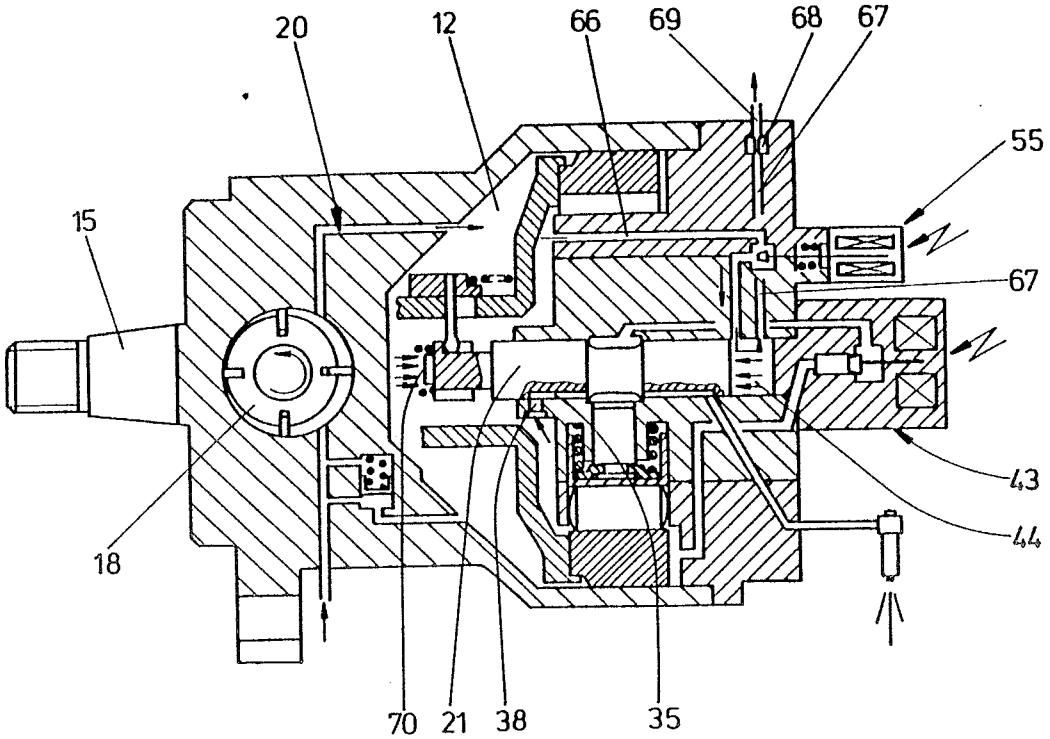

The embodiment of a distributor fuel injection radial piston shown in FIG. 4 is somewhat more extensively modified relative to the fuel injection pump in FIG. 1 than the embodiment examples in FIGS. 2 and 3. The pressure line 20 leading from the delivery pump 18 is directly connected with the pump interior 12. The control space 44 in the distributor cylinder 22 is connected with the pump interior 12 via an inflow line 66 and is connected to an outlet opening 69 provided in the cover 11 via an outflow line 7 with the intermediary of a throttle 68. The outlet opening 69 communicates in turn with the fuel tank via a fuel return line. The second control valve 55 is arranged in the inflow line 66. The connection of the drive shaft 15 and the distributor piston 21 is effected in such a way that the front side 70 of the distributor piston 21 projecting into the pump interior 12, is acted upon by the fuel pressure prevailing in the pump interior 12.

Figure 4B:
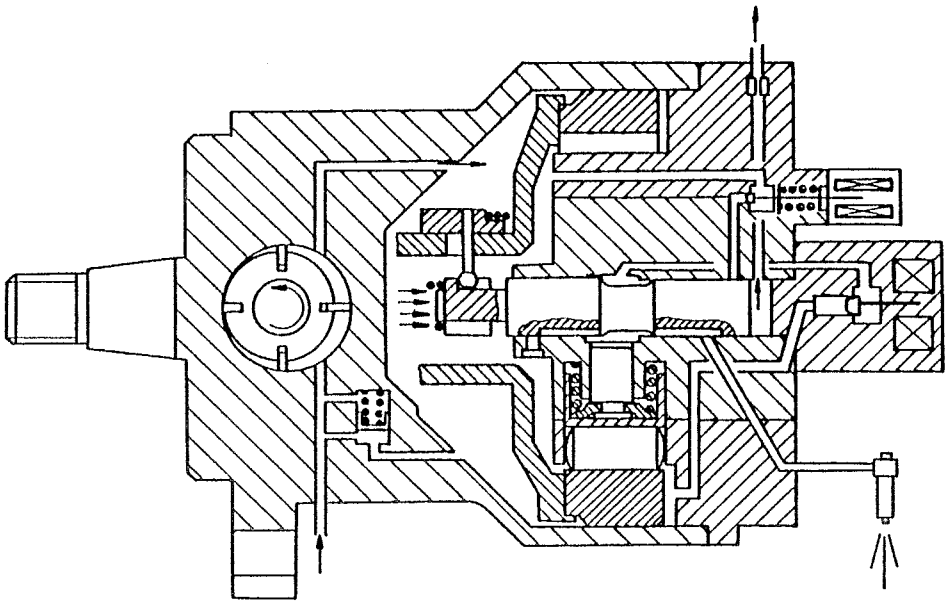

If the first control valve 43 remains stuck in its closing position due to a defect, the second control valve 55 is controlled—as in the fuel injection pump in FIG. 1—the monitoring device 60. This second control valve 55 closes, so that no more fuel can flow out of the pump interior 12 into the control space 44 via the inflow line 66. Only the connection of the control space 44 to the outlet opening 69 via the outflow line 67 remains intact. There is now n counter-pressure in the control space 44 opposed to the pressure acting on the front side 70 of the distributor piston 21, so that the distributor piston 21 is displaced to the right in FIG. 4*a* and occupies its axial displacement position shown in FIG. 4*b*. In this displacement position, the filling groove 35 is displaced far enough to the right that it is no longer capable of overlapping the filling bore 38 in the distributor cylinder 22 (FIG. 4*b*). The pump work space 32 is accordingly separated from the pump interior 12 and can no longer be filled with fuel during the suction stroke of the pump piston 26. During a defect in the first control valve 43 the fuel feeding to the injection nozzle 37 is interrupted.

The embodiments of the distributor fuel injection pumps according to FIGS. 2–4 differs from the fuel injection pump in FIG. 1 only by the modifications mentioned above. Moreover, the construction and manner of functioning are the same, so that the same reference numbers have also been used for the same structural elements. For the sake of simplicity, the reference numbers in FIGS. 2–4 are only entered as required for understanding the differences relative to FIG. 1.

What is claimed:

1. A distributor fuel injection radial piston pump for feeding fuel to at least one injection nozzle of an internal combustion engine, said pump comprising:

a housing defining a pump interior;

at least one pump piston located in said housing and defining at least partially a pump working space, said one pump piston being displaceable in said housing to perform a suction stroke during which said pump working space is filled with fuel, and a discharge stroke during which fuel is fed from said pump working space to the one injection nozzle;

a distributor piston having an end face and being axially displaceable between a first axial position in which it enables communication of said pump working space with the injection nozzle and a second axial position in which it prevents communication of said pump working space with the injection nozzle;

a first control valve for controlling a quantity of fuel fed to the injection nozzle, said first control valve being movable between open and closed positions to communicate said pump working space with said pump interior therethrough in the open position thereof to prevent feeding of fuel to the injection nozzle and blocking communication between said pump working space and said pump interior therethrough in the closing position thereof to provide for feeding fuel to the injection nozzle; and means for preventing excessive feeding of fuel to the nozzle in case of failure of said first control valve to move from the closed position thereof to the open position thereof in response to a predetermined control signal, said prevent means including a control space defined at least partially by said end face of said distributor piston and a second control valve for changing pressure in said control space to move said distributor piston to the second axial position thereof in which feeding of fuel to the injection nozzle is prevented.

2. A pump according to claim 1 further comprising:

drive means for displacing said pump piston and including a drive shaft and cam drive means connected to said drive shaft for reciprocally displacing said pump piston radially relative to said drive shaft to cause said pump piston to perform the suction and discharge strokes; and a distributor cylinder arranged coaxially with said drive shaft and having a plurality of bores;

said distributor piston being received in said distributor cylinder and having an end opposite to said end face and projecting from said distributor cylinder, said distributor piston having a circumference and a plurality of grooves formed on said circumference, and said distributor piston being connected with said drive shaft at said opposite end thereof for axial displacement relative thereto between said first and second axial positions and for joint rotation therewith between first and second rotational positions, said plurality of grooves of said distributor piston cooperating with said plurality of bores of said distributor cylinder to connect said working space with said pump interior in the first axial position and in the first rotational position of said distributor piston and to connect said pump working space with the injection nozzle in the first axial position and the second rotational position of said distributor piston, and to effect one of connecting said pump working space with said interior in the second axial position and in the second rotational position of said distribution piston and blocking connection between said pump working space and said pump interior in the second axial position and the first rotational position of said distribution piston.

3. A pump according to claim 2 comprising a feeding pump for feeding fuel into said pump interior and a pressure line for communicating fuel from said feeding pump to said pump interior.

4. A pump according to claim 3 further comprising means for increasing pressure in said control space.

5. A pump according to claim 3 further comprising means for decreasing pressure in said control space.

6. A pump according to claim 3, wherein said pressure line extends through said control space and has a line portion extending between said control space and said pump interior and including an outlet opening and a throttle therein, said second control valve being arranged in said line portion.

7. A pump according to claim 6 further comprising a bore communicating said distributor cylinder with said pump interior, said bore being overlapped by said distributor piston and communicating with said control space only in the second axial position of said distributor piston.

8. A pump according to claim 6, wherein said plurality of grooves of said distributor piston comprises an annular groove defining together with said pump piston said pump working space and an axial filling groove, said plurality of bores of said distributor cylinder including a filling bore communicating said annular groove of said distributor piston with said pump interior via said filling groove in the first rotational position of said distributor piston, and said filling groove having a length dimensioned in such a way that it projects out of said distributor cylinder into said pump interior in the second axial position of said distributor piston.

9. A pump according to claim 6, wherein said plurality of grooves includes an annular groove defining together with said pump piston said pump working space, and an axial filling groove, said distributor piston having a ring land having an external diameter equal to that of said distributor piston and dividing said annular groove in a first portion communicating with said filling groove and a second portion, said distributor cylinder having an inner wall cooperating with said ring land to block communication between said first and second portions of said annular groove in the second axial position of said distributor piston, said plurality of bores of said distributor cylinder including a filling bore communicating with said first portion of said annular groove via said filling groove.

10. A pump according to claim 6, wherein said plurality of grooves of said distributor piston comprises an annular groove having an axial length defining together with said pump piston said pump working space and an axial filling groove, said plurality of bores of said distributor cylinder including a filling bore communicating said annular groove with said pump interior in the first position of said distributor piston, said distributor cylinder having an inner wall overlapping completely the axial length of said annular groove in the second axial position of said distributor cylinder.

11. A pump according to claim 6, further comprising a by-pass having first and second by-pass portions, a relief line having a first relief line portion extending between said first control valve and said pump working space and a second relief line portion extending between said first control valve and said pump interior, said first by-pass portion communicating with said first relief line portion and said second by-pass portion communicating with said second relief line portion, said by-pass being blocked in the first axial position of the distributor piston and communicating with said control space in the second axial position of the distributor piston.

12. A pump according to claim 1, further comprising an inflow line communicating said control space with said pump interior, an outlet opening in said pump interior, and an outflow line for communicating said control space with said outlet opening, said outlet opening having a throttle said second control valve being arranged in said inflow line, and said opposite end of said distributor piston having an end surface acted upon by the pressure in said pump interior.

13. A pump according to claim 12, wherein said plurality of grooves of said distributor piston includes an annular groove defining together with said pump piston said pump working space and an axial filling groove, said plurality of bores of said distributor cylinder including a filling bore communicating in the first rotational position of said distributor piston said annular groove via said filling groove with said pump interior, said filling groove having an axial length dimensioned in such a way that it clears said filling bore in the second axial position of said distributor piston.

14. A pump according to claim 1 further comprising a device for monitoring functioning of the first control valve and for communicating a closing command to said second control valve when said first control valve fails to move from the closing position in response to the predetermined control signal.

15. A pump according to claim 14, wherein said monitoring device comprises a speed detector for generating the closing command in response to an engine speed exceeding a predetermined maximum speed.

16. A pump according to claim 14, wherein said second control valve is an electric control valve formed in such a way that it is closed in its unexcited normal position and is opened in its excited work position.

17. A pump according to claim 1, wherein said first control valve is an electric control valve.

* * * * *